US009677765B2

(12) United States Patent
Metz et al.

(10) Patent No.: US 9,677,765 B2
(45) Date of Patent: Jun. 13, 2017

(54) PNEUMATIC COMPOSITE HAVING MASS BALANCING

(75) Inventors: Tobias Metz, Buch Am Erlbach (DE); Roland Keber, Wörth a.d. Isar (DE); Rudolf Tungl, Landshut (DE)

(73) Assignee: ebm-papst Landshut GmbH, Landshut (DE)

( * ) Notice: Subject to any disclaimer, the term of this patent is extended or adjusted under 35 U.S.C. 154(b) by 710 days.

(21) Appl. No.: 13/583,232

(22) PCT Filed: Feb. 28, 2011

(86) PCT No.: PCT/EP2011/052949

§ 371 (c)(1),
(2), (4) Date: Sep. 7, 2012

(87) PCT Pub. No.: WO2011/110439

PCT Pub. Date: Sep. 15, 2011

(65) Prior Publication Data

US 2013/0045077 A1 Feb. 21, 2013

(30) Foreign Application Priority Data

Mar. 10, 2010 (DE) ..... 10 2010 010 952

(51) Int. Cl.
*F23N 1/02* (2006.01)
*F23N 5/18* (2006.01)

(52) U.S. Cl.
CPC ..... *F23N 1/022* (2013.01); *F23N 5/184* (2013.01); *F23N 2005/181* (2013.01); *F23N 2033/08* (2013.01)

(58) Field of Classification Search
CPC .. F04D 15/00; F04D 15/0066; F04D 15/0044; F04D 29/42; F04D 29/441;
(Continued)

(56) References Cited

U.S. PATENT DOCUMENTS 5,938,527 A * 8/1999 Oshima ..... F24F 1/01 454/303
8,286,594 B2 * 10/2012 Smelcer ..... F23D 14/02 122/13.3

FOREIGN PATENT DOCUMENTS

DE 197 29 047 9/1998
DE 19729047 C1 * 9/1998 ..... F23D 14/64
(Continued)

OTHER PUBLICATIONS

Written Opinion and Preliminary Report of Internation Searching Authority mailed Mar. 28, 2013 in the corresponding PCT Application No. PCT/EP2011/052949 (9 pages).

*Primary Examiner* — Craig Kim
*Assistant Examiner* — Juan G Flores
(74) *Attorney, Agent, or Firm* — Harness, Dickey & Pierce, P.L.C.

(57) ABSTRACT

A blower device for delivering at least one medium includes a blower having a housing with an inlet and an outlet, a nozzle, which is fluidically connected and arranged on the housing such that at least one medium can flow there through. The nozzle is designed to effect a negative pressure on the at least one medium at least in some sections. At least one sensor is arranged in the effective region of the nozzle and designed to measure at least parameters of the at least one medium which are required to determine the mass of the at least one medium.

15 Claims, 2 Drawing Sheets

(58) Field of Classification Search
CPC .... F23N 1/022; F23N 5/184; F23N 2005/181; F23N 2033/08
See application file for complete search history.

(56) References Cited

FOREIGN PATENT DOCUMENTS

| | | | | |
|---|---|---|---|---|
| DE | EP 1333227 A2 * | 8/2003 | ..... | F23N 3/002 |
| DE | 103 49 344 | 6/2005 | | |
| EP | 1 243 857 | 9/2002 | | |
| EP | 1243857 A1 * | 9/2002 | ..... | F23N 5/18 |

* cited by examiner

PNEUMATIC COMPOSITE HAVING MASS BALANCING

CROSS-REFERENCE TO RELATED APPLICATIONS

This application is a 371 U.S. National Stage of International Application No. PCT/EP2011/052949, filed on Feb. 28, 2011. This application claims priority to German Patent Application No. 10 2010 010 952.5, filed on Mar. 10, 2010. The contents of the above are herein incorporated by reference in their entirety.

The invention relates to a blower device for delivering at least one medium, the device comprising at least one blower having a housing, a nozzle and a sensor. The invention also relates to methods for controlled or regulated operation of the blower device, the mass of the medium flowing through the nozzle being measured by the sensor, the measured values being passed electronically to a control or regulation system which adjusts the speed of the blower such that the required values are achieved on the sensor, a second medium supplied to the nozzle being pneumatically adjusted at the same time in a corresponding manner.

The invention is intended specifically for mixing blowers for delivering and mixing combustible media with air, which usually deliver the combustible mixture to a series-connected burner.

Such blowers are preferably used in heating technology as they guarantee good preliminary mixing of the fuel with air. To ensure optimum regulation of the fuel and air mixing ratio, both pneumatic and electronic regulation and control systems are known in the prior art, although these are not without disadvantages in terms of adjusting the mixing ratio. Many influencing parameters have to be taken into account with pre-mixing blowers for gas burners to guarantee the correct mixing ratio of air and gas (Lambda air coefficient), since adjusting the air coefficient quickly and correctly is extremely important to ensure clean combustion having a high level of efficiency.

The pneumatic composite system is characterised in that valves are controlled pneumatically, the control pressure being provided by the volume flow rate generated in the blower and recorded at a corresponding position, e.g. at the air inlet of the blower. Controlling the valve (gas valve) leads to a quantity of gas which is then adjusted to the quantity of air taken in by the blower and mixed. The higher the negative pressure, the wider the valve opens and the greater the amount of gas supplied. The negative pressure is dependent on the amount of air taken in per unit of time and the air flow speed. The correlation between air pressure and flow speed is known from Bernoulli's equation. When using the pneumatic composite system in gas heating systems, a specific speed is set on the gas blower to achieve a preset heating output, and the required air-gas mixture is adjusted by the pneumatic composite system. This mixture is supplied to the burner and burned. The correlation between heating output and the impeller speed is stored in the control system. The pneumatic composite system is characterised by the simplicity of its components which are primarily designed as elements which are controlled passively by flow mechanics.

The disadvantage of the pneumatic composite system is that the blower speed required to achieve a preset heating output can be influenced by a variety of general conditions. In particular, changing air pressures or temperatures of the intake air can lead to considerable fluctuations in the heating output. This is particularly disadvantageous if systems are to be operated at different geodetic heights and the air pressure is significantly less than the average air pressure and thus the heating output is permanently below the preset values. Admittedly, this negative influence can be minimised by calibrating the system for different geodetic heights, but this is time-consuming and expensive. Influencing factors such as a fluctuating temperature of the intake air or quality differences in the combustion gas and pressure differences in the gas lines can also not be compensated by calibration.

In order to overcome the disadvantages of the pneumatic composite system, the electronic composite system was developed, as disclosed in German patent DE 10 2004 055 715 B4. This document discloses a method for adjusting gas burner operating parameters in which the supplied air mass is recorded and can be regulated independently of geodetic influences by means of an air mass meter. A sensor for measuring the resulting temperature is also provided to record all general conditions electronically and ideally adjust the correct mixing ratio (lambda) independently of external influencing variables, such as the quality of the heating gas, for example. Full electronic recording and electronic adjustment of all variables (blower speed, gas valve position) does admittedly ensure very precise regulation, but this is associated with considerable regulation complexity and individual regulation systems both for the supplied air quantity, i.e. speed regulation, and the quantity of gas supplied, i.e. gas valve regulation. The system is therefore much more complex and expensive compared with the pneumatic composite system.

The object of the present invention is therefore to provide a device and a method which overcome the disadvantages of the prior art. The blower device should therefore be more reasonably-priced than the electronic composite, but should still be able to compensate for pressure fluctuations in the supplied medium.

The object is achieved according to the invention by providing a blower device for delivering at least one medium, this device comprising a blower having a housing with an inlet and an outlet, a nozzle, which is fluidically connected and arranged on the housing such that at least one medium can flow through this nozzle, the nozzle being designed, at least in some sections, to effect a negative pressure in the at least one medium, and at least one sensor, the sensor being arranged in the effective region of the nozzle and designed to measure at least one parameter of the at least one medium required to determine the mass of the at least one medium.

In this case, the effective region of the nozzle comprises every region which is affected by the flow altered by the nozzle (e.g. flow speed, pressure).

The object is also achieved by a method for regulated operation of a specified blower device, the sensor arranged in the effective region of the nozzle measuring the value of the mass of a first medium flowing through the nozzle, passing the measured value to a regulation system by means of an electronic signal line, the regulation system regulating the speed of the blower impeller as a function of the value measured by the sensor until the value measured by the sensor corresponds to a set value stored in the regulation system, regulating the speed changing the quantity of a second medium supplied to the nozzle pneumatically at substantially the same time and in a linear relationship to the change in mass of the first medium.

The object is also achieved by a method for controlled operation of a specified blower device, the sensor arranged in the effective region of the nozzle measuring the value of the mass of a first medium flowing through the nozzle, passing the measured value to the control system by means of the electronic signal line, the control system controlling the speed of the blower impeller as a function of the value measured by the sensor, controlling the speed changing the quantity of a second medium supplied to the nozzle pneumatically at substantially the same time and in a linear relationship to the change in mass of the first medium.

The invention is much simpler and advantageously dispenses as far as possible with the need for expensive electronic elements requiring intensive regulation or control systems. By way of example, electronic recording of the second medium—the gas volume flow rate—is not required, nor is electronic control or regulation of the gas valve, as required in the prior art. The invention is particularly used for mixer blowers for use in heating technology where air is taken in as the main flow and combustion gas is provided and added via a supply component. The invention is substantially concerned with a pneumatic composite system which comprises electronic recording of the air mass in the main air flow and which is able to provide mass balancing via a control or regulation system. The blower device according to the invention is designed to deliver at least one medium, the at least one medium preferably being air. The sensor arranged in the effective region of the nozzle can measure the air mass in a variety of ways. In principle, it is possible to use any sensor element which is suitable for measuring one or more variables which can be used alone or in combination in clear relation to the mass flow passing through the nozzle. Merely measuring the volume flow rate is not sufficient and would only be possible if additional measurement variables were recorded, e.g. air density, and if a conversion device was provided to calculate the air mass from the measurement variables. However, the quantity of air delivered by the blower is stable and is merely dependent on speed if the conditions are sufficiently stable. In order to determine the mass flow in this case, it is sufficient to have a sensor to determine this directly or indirectly in consideration of speed regulation. The air mass can be determined indirectly by measuring the following parameters in an appropriate combination, for example: sound velocity, density, Doppler effect, heat capacity or thermal transfer capacity, barometric pressure, ionisation capacity, speed of light, oxygen isotope concentration, electromagnetic or magnetic permeability, absorption coefficient for certain electromagnetic or mechanical waves and all other variables which are particularly associated with air density. To this end, the blower device may also comprise an electronic evaluation unit which evaluates the sensor signal and converts it to an electronic signal which can be associated with the mass flowing through. Transmission of the signals is described in greater detail below.

In an advantageous embodiment of the invention, the nozzle comprises an additional channel through which at least part of the at least one medium (air) flows, the sensor being arranged in the additional channel. Compared with pneumatic composite systems of the prior art, in the present invention it is no longer necessary to provide a bypass to measure the mass flow; now it is simply sufficient to fit the sensor directly on the nozzle, e.g. in the additional channel, through which extra air is taken in. By omitting a complex bypass design, the system is much simpler. Alternatively, the nozzle may also comprise at least two supply lines for the at least one medium (air), the first supply line comprising the main flow and the second supply line being designed in the form of a channel and inside which the sensor is arranged. By arranging the sensor in a second supply line in the form of a channel or an additional channel arranged on the nozzle, enough of the overall flow passes through the sensor to allow the mass flow rate to be determined clearly.

In a preferred embodiment of the invention, the nozzle is designed as a Venturi nozzle and arranged such that it is directly connected to the inlet of the blower housing, i.e. the Venturi nozzle is connected upstream of the blower in the flow direction, in order to make use of the higher flow speeds resulting in the Venturi nozzle according to Bernoulli's equation in the nozzle inlet itself. It is also advantageous to use a Venturi nozzle since the mass flow in such a nozzle is well controlled and this makes it easier to measure using the sensor. The mass flow in the additional channel or in the second supply line comes under the effective region of the Venturi nozzle and is in particular adjusted by the negative pressure generated in the Venturi nozzle with the result that there is a direct relationship with the main mass flow as a result of the Venturi nozzle itself and the mass flow rate in the overall Venturi nozzle can be deduced from the value of the mass flow rate measured in the supply line or the additional channel.

When using an additional channel, it is also preferable if said channel extends in a substantially parallel direction over a predetermined section of the nozzle and leads into a region of the nozzle which is located in front of a nozzle section, in the direction of flow, in which the cross-section of the nozzle is minimal. The partial flow passed into the additional channel is then returned to the main flow passing through the inside of the nozzle in a region before the narrowest cross-section. Admittedly, it is also possible to return the flow directly in the narrowest cross-section or after the narrowest cross-section in the direction of flow, but this can lead to disadvantages in terms of flow.

In another embodiment of the invention, the nozzle comprises a supply element via which a second medium is supplied by means of the negative pressure generated by the nozzle, the supplied quantity of the second medium being controlled exclusively by the difference in pressure resulting from the negative pressure of the nozzle. Gas is preferably used as the second medium. The supply element is preferably designed as a gas line which comprises a gas valve which controls the supplied amount of gas depending on the opening position. According to the invention, the negative pressure generated by the nozzle may affect the gas valve either directly or indirectly and guarantee a wide-open position of the gas valve with a high negative pressure and a more closed position in the case of a smaller negative pressure. It is thus not necessary to have additional electronic measurement or regulation devices for the gas valve.

A further advantage of the blower device according to the invention is that the sensor is connected electronically to a control or regulation system and can pass the measured parameters of the at least one medium to the control or regulation system via an electronic signal line. In a preferred embodiment, the sensor advantageously records the value of the air mass flowing through the nozzle per unit of time by means of a fibre-optic line and passes this on to the control or regulation system.

The blower device according to the invention can be controlled and/or regulated both via a control system and via a regulation system, the control system in a first alternative being designed to control the speed of a blower impeller as a function of the value of the parameter measured by the sensor, and in an alternative embodiment, the blower is equipped with a regulation system which is designed to regulate the speed of a blower impeller as a function of the value of the parameter measured by the sensor until the measured value corresponds to a set value stored in the regulation system. The advantage of regulated operation is that the new mass value measured by the sensor in each case can be checked and fed back to the regulation system after a change in the air mass flow rate by varying the speed of the blower impeller. In the case of the control system, only the new speed value is controlled, without checking the mass flow rate actually achieved.

In order to guarantee a defined control or regulation system, it is advantageous to store a characteristic curve in a memory in the control or regulation system which determines the speed of the blower impeller as a function of the heating output required by the burner if the blower according to the invention is designed as a radial blower for burners pre-mixing air and gas, as is preferable. Pre-mixing can take place via the nozzle connected in front of the housing or may also or additionally take place inside the blower housing itself.

In accordance with a preferred method according to the invention, the blower is operated in a regulated manner, the mass flow sensor arranged in the effective region of the nozzle fixed to the inlet of the housing, e.g. in an additional channel, measuring the value of the air mass flowing through the nozzle. In a second stage of the method according to the invention, the value measured by the mass flow sensor is sent to the regulation system via an electronic signal line, upon which the regulation system regulates the speed of the blower in consideration of the measured value in such a way that the value measured by the sensor corresponds to the set value stored in the regulation system. In addition, the method is characterised by the fact that the air mass flowing through the nozzle generates a specific negative pressure which pneumatically determines the opening position of a gas valve and thus a second medium supplied to the nozzle having the result that regulating the air mass flow by changing the speed of the blower impeller leads directly to a corresponding change in the supplied gas mass.

In an alternative embodiment of the method, a control system is used instead of a regulation system, in which there is no regulation until the value measured by the sensor corresponds to a set value stored in the regulation system, but the system merely controls to a preset speed value. The remaining stages in the method are identical to the regulation method.

In a preferred embodiment of the invention, the elements making up the blower device are arranged such that the control or regulation method according to the invention leads to a pneumatic change in the supplied mass of the second medium (gas), which is in a linear relationship to the supplied mass of the first medium (air) and takes place at substantially the same time as the change in mass of the first medium by varying the speed.

The invention is illustrated schematically by way of example in the figures below, the same reference numerals being used to identify identical elements.

These are as follows.

Figure 1:
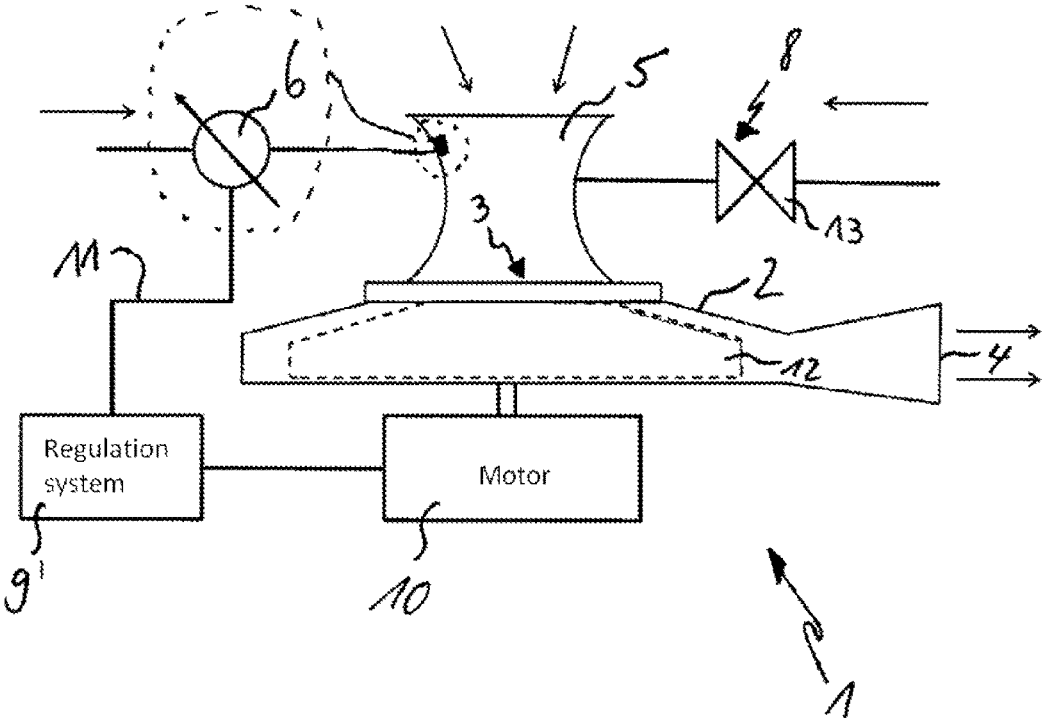
FIG. 1 is a schematic view of the blower device according to the invention.

FIG. 1 is a schematic representation of a device comprising a blower 1 for delivering a mixture of air and gas. The blower 1 has a housing 2 with an inlet 3 and an outlet 4, a nozzle 5 being fluidically connected directly to the housing 2 at the inlet 3. A blower impeller 12 driven by a motor 10 is arranged inside the housing 2. The nozzle 5 is designed as a Venturi nozzle, an inlet region with a large cross-section tapering to a section with a much narrower cross-section in accordance with this type of nozzle, the cross-section then widening again towards the inlet 3 of the housing 2 to substantially return to its original value. Operating the blower impeller 12 generates a flow. In this process, air is taken in through the Venturi nozzle 5, amongst other things, and accelerated in the region with a reduced cross-section, thus forming a negative pressure. A supply element 8 is arranged on the Venturi nozzle 5 in the region with a reduced cross-section, through which the fuel, preferably gas, can be supplied. The quantity of gas supplied is determined as a function of the opening position of the gas valve 13, which is affected by the negative pressure of the nozzle 5 and determines the opening position. The quantity of gas supplied is thus directly and linearly dependent on the negative pressure value, i.e. the speed of the blower impeller 12. The sensor 6 for determining the air mass flowing through the Venturi nozzle 5 is arranged in the effective region of the Venturi nozzle 5. In the illustrated embodiment, the sensor 6 is fixed to the inner wall of the Venturi nozzle 5 in such a way that the sensor 6 is exposed directly to the main flow of the incoming air. In the schematic representation, the sensor 6 is shown in enlarged scale next to the Venturi nozzle 5, this sensor being electronically connected to a regulation system 9' via an electronic signal line 11 and passing the measured values to the regulation system 9' via the signal line 11. The regulation system 9' is connected to the motor 10 to adjust the speed of the blower impeller 12 as a function of the values measured by the sensor 6.

Figure 2:
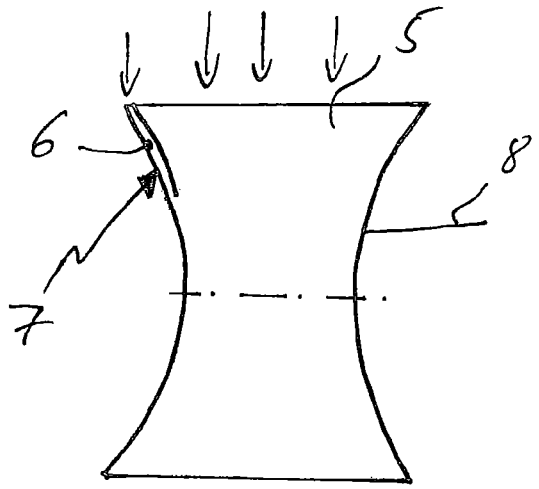
FIG. 2 is a schematic representation of an alternative embodiment of the nozzle

FIG. 2 illustrates an alternative embodiment of the Venturi nozzle 5, the remaining elements being assumed to be identical to FIG. 1. The nozzle 5 has an additional channel 7 in the inlet region in which the sensor 6 is arranged. An ancillary flow is taken in through the additional channel 7, this being designed such that the mass of the main flow can be estimated by measuring the ancillary flow. The losses in a well-designed Venturi nozzle 5 are so minimal that they can easily be tolerated. The additional channel 7 runs substantially parallel to the outer wall of the nozzle 5 and leads back into the main flow of the nozzle 5 in a region which lies in front of the nozzle section, in the direction of flow, in which the cross-section of the nozzle 5 is minimal.

Figure 3:
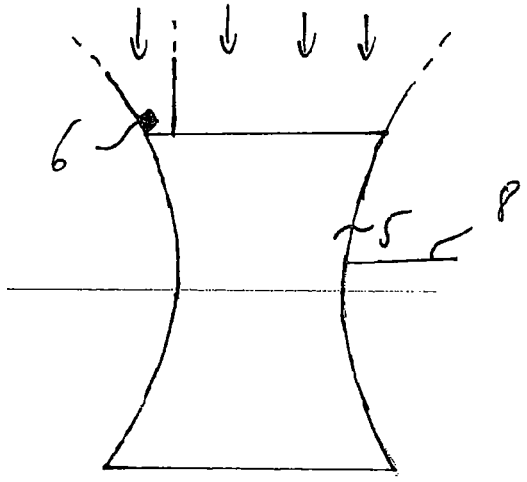
FIG. 3 is a schematic representation of another alternative embodiment of the nozzle.

FIG. 3 shows another alternative embodiment of the arrangement of the sensor 6, the features not illustrated in FIG. 1 also being used in this embodiment. The nozzle 5 has two supply lines, a first supply line conveying a main flow and a second supply line conveying an ancillary flow. The sensor 6, which measures the supplied air mass and conveys it to the regulation system via a signal line, which is not illustrated, is arranged in the second supply line, which is substantially channel-shaped.

During operation of the blower 1 as shown in FIG. 1 or the embodiments shown in FIGS. 2 and 3, the air mass taken in via the blower impeller 12 is measured using the sensor 6 and the measured value is passed via an electrical signal line 11 to a regulation system 9', the regulation system regulating the speed of the impeller 12 of the blower 1 as a function of the value measured by the sensor 6 until the measured value corresponds to a set value stored in the regulation system 9'. The sensor 6 is arranged in the effective region of the Venturi nozzle 5 and measures the mass of combustion air passing through the Venturi nozzle 5. The Venturi nozzle 5 creates a negative pressure as the air flows through, this pressure affecting the opening position of the gas valve via a supply element 8 or an additional line, and thus creating a wider opening position of the gas valve 13 and thus a greater amount of gas supplied as a result of a greater negative pressure in the presence of larger air masses. By changing the speed of the impeller 12, the quantity of gas supplied is adjusted accordingly both automatically and pneumatically. This adjustment takes place at substantially the same time and in a linear relationship to the change in the supplied air mass.

Alternatively, a control system 9 can be used instead of a regulation system 9', the speed being controlled via a stored characteristic curve, but the value achieved is not returned and checked against a set value.

The invention is not limited to the preferred embodiments described above. Instead, there are a number of conceivable alternatives which make use of the illustrated solution even in embodiments which are fundamentally different. For example, if the air mass is not measured directly by the sensor, an electronic evaluation unit may be provided which evaluates a signal from the sensor and converts it to an electronic signal which can be assigned to the mass flowing through.

The invention claimed is:

1. A mixer blower device for mixing air and a gas, the mixer blower device comprising:

a. a mixer blower having a housing with an inlet and an outlet, b. a nozzle, which is fluidically connected and arranged on the housing such that the air can flow through the nozzle, the nozzle being designed to effect a negative pressure on the air flowing through the nozzle, and c. a mass flow sensor arranged in an effective region of the nozzle and designed to measure a mass of only the air flowing through the nozzle; wherein the nozzle has a supply element having a gas valve via which the gas is supplied by means of the negative pressure generated by the nozzle, a supplied quantity of the gas being controlled exclusively by the negative pressure of the air flowing through the nozzle, the supplied quantity of the gas being determined based on an opening position of the gas valve, and the opening position of the gas valve being pneumatically determined by the negative pressure of the air flowing through the nozzle;

the mass flow sensor is electronically connected to a control system or a regulation system, the control system or the regulation system receives the mass for the air from the mass flow sensor as a value via an electronic signal line;

the control system controls a speed of an impeller of the blower as a function of the value of the mass of the air flowing through the nozzle measured by the mass flow sensor, or the regulation system regulates the speed of the impeller of the blower as a function of the value of the mass of the air flowing through the nozzle measured by the mass flow sensor until the measured value corresponds to a set value stored in the regulation system; and the control system or the regulation system includes a storage device that stores a predefined characteristic curve, which determines the speed of the impeller of the blower as a function of a heating output required for a burner.

2. The mixer blower device according to claim 1, wherein an electronic evaluation unit is provided which receives a sensor signal from the mass flow sensor, the electronic evaluation unit converting the sensor signal to an electronic signal which is assigned to the mass of the air.

3. The mixer blower device according to claim 1, wherein the nozzle has an additional channel through which at least part of the air flows, the mass flow sensor being arranged in the additional channel.

4. The mixer blower device according to claim 3, wherein the additional channel runs substantially parallel to the nozzle and leads into a region of the nozzle which lies in front of a nozzle section, in the direction of flow, in which the cross-section of the nozzle is minimal.

5. The mixer blower device according to claim 1, wherein the nozzle has at least two supply lines for the air, the second supply line being designed in the form of a channel and the mass flow sensor being arranged within the second supply line.

6. The mixer blower device according to claim 1, wherein the nozzle is designed as a Venturi nozzle and is arranged such that it is directly connected to the inlet of the housing.

7. The mixer blower device according to claim 1, wherein the blower is designed as a radial blower for burners premixing the air and the gas, wherein said premixing takes place at least partially via the nozzle.

8. A method for regulated operation of the mixer blower device according to claim 1, the method comprising:

arranging the mass flow sensor in the effective region of the nozzle, measuring the value of the mass of the air flowing through the nozzle, passing the measured value to the regulation system via the electronic signal line, the regulation system regulating the speed of the impeller of the mixer blower as the function of the value measured by the mass flow sensor until the value measured by the mass flow sensor corresponds to the set value stored in the regulation system, regulating the speed changing a quantity of the gas supplied to the nozzle pneumatically with respect to a change in mass of the air.

9. The method according to claim 8, wherein the quantity of the gas supplied to the nozzle is changed at substantially the same time and in a linear relationship to the change in mass of the air by controlling or regulating the speed.

10. A method for controlled operation of mixer blower device according to claim 1, the method comprising:

arranging the mass flow sensor in the effective region of the nozzle, measuring the value of the mass of the air flowing through the nozzle, passing the measured value to the control system via the electronic signal line, the control system controlling the speed of the impeller of the mixer blower as the function of the value measured by the mass flow sensor, controlling the speed changing a quantity of the gas supplied to the nozzle pneumatically with respect to a change in mass of the air.

11. The method according to claim 10, wherein the quantity of the gas supplied to the nozzle is changed at substantially the same time and in a linear relationship to the change in mass of the air by controlling or regulating the speed.

12. The mixer blower device according to claim 1, wherein the nozzle includes a narrow cross-section disposed between an inlet and an outlet of the nozzle, the narrow cross-section having a cross-section smaller than a cross-section of the inlet of the nozzle and smaller than a cross-section of the outlet of the nozzle.

13. The mixer blower device according to claim 12, wherein the cross-section of the inlet of the nozzle is the same as the cross-section of the outlet of the nozzle.

14. The mixer blower device according to claim 1, wherein a cross-section of an inlet of the nozzle is the same as a cross-section of an outlet of the nozzle.

15. A mixer blower device for mixing air and a gas, the mixer blower device comprising:

a. a mixer blower having a housing with an inlet and an outlet, b. a nozzle, which is fluidically connected and arranged on the housing such that the air can flow through the nozzle, the nozzle being designed to effect a negative pressure on the air flowing through the nozzle, and c. a mass flow sensor arranged in an effective region of the nozzle and designed to measure a mass of the air flowing through the nozzle; wherein;

the nozzle has a supply element via which the gas is supplied by means of the negative pressure generated by the nozzle, a supplied quantity of the gas being controlled by the negative pressure of the air flowing through the nozzle;

the supply element includes a gas valve, the supplied quantity of the gas being determined based on an opening of the gas valve, and the opening of the gas valve being pneumatically controlled by the negative pressure of the air flowing through the nozzle;

the mass flow sensor is electronically connected to a control system or a regulation system, the control system or the regulation system receives the mass of the air from the mass flow sensor as a value via an electronic signal line;

the control system controls a speed of an impeller of the mixer blower as a function of the value measured by the mass flow sensor, or the regulation system regulates the speed of the impeller of the blower as a function of the value measured by the mass flow sensor until the measured value corresponds to a set value stored in the regulation system; and the control system or the regulation system includes a storage device that stores a predefined characteristic curve, which determines the speed of the impeller of the mixer blower as a function of a heating output required for a burner.

* * * * *